United States Patent [19]

Kwiatkowski

[11] 4,163,333

[45] Aug. 7, 1979

[54] CANDLE BOX

[76] Inventor: Joseph Kwiatkowski, Rte. 1, Box 1040, Rainier, Wash. 98576

[21] Appl. No.: 914,894

[22] Filed: Jun. 12, 1978

Related U.S. Application Data

[63] Continuation of Ser. No. 760,649, Jan. 19, 1977, abandoned.

[51] Int. Cl.[2] ..... F21V 35/00

[52] U.S. Cl. ..... 40/561; 362/161; 362/806

[58] Field of Search ..... 362/125, 154, 161, 163, 362/312, 314, 806; 40/561, 562; 431/289, 291

[56] References Cited

U.S. PATENT DOCUMENTS

| | | | |
|---|---|---|---|
| 218,750 | 8/1879 | Jory | 40/580 |
| 786,610 | 4/1905 | Terry | 40/518 R |
| 861,689 | 7/1907 | Wilhems | 40/579 |
| 1,660,760 | 2/1928 | Murphy | 362/806 |
| 1,764,639 | 6/1930 | Nathansohn | 40/561 |
| 1,915,236 | 6/1933 | Messner et al. | 40/502 R |
| 2,298,940 | 10/1942 | Hayes | 40/577 |
| 3,334,218 | 8/1967 | Nawrocki | 362/161 |
| 3,368,198 | 2/1968 | Eikenberry | 340/103 |
| 3,666,936 | 5/1972 | Webster et al | 40/444 |

*Primary Examiner*—Carroll B. Dority, Jr.
*Attorney, Agent, or Firm*—Cole, Jensen & Puntigam

[57] ABSTRACT

A candle box having a solid bottom and back and further including side panels having openings to permit insertion of a candle and to admit air and light therein. A front panel having a transparent member with designs imprinted thereon completes the enclosure. A reflective surface mounted to the back member behind the transparent member reflects a candle placed within the box as well as reflecting the design imprinted upon the transparent front member and light admitted from the sides and top. The candle, the design and reflection can all be seen.

1 Claim, 5 Drawing Figures

Fig. 3
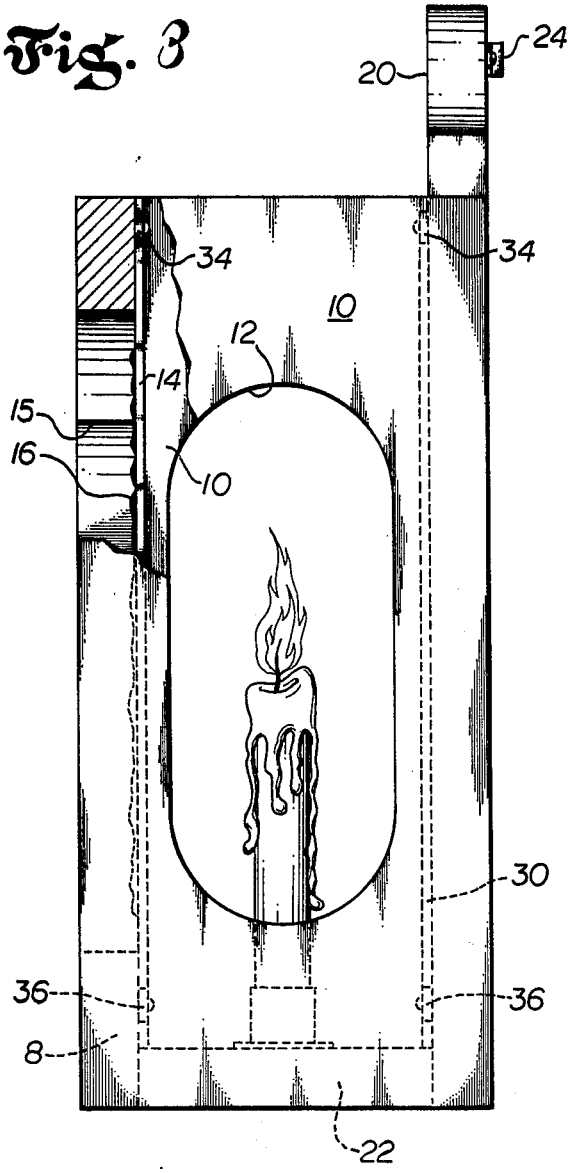
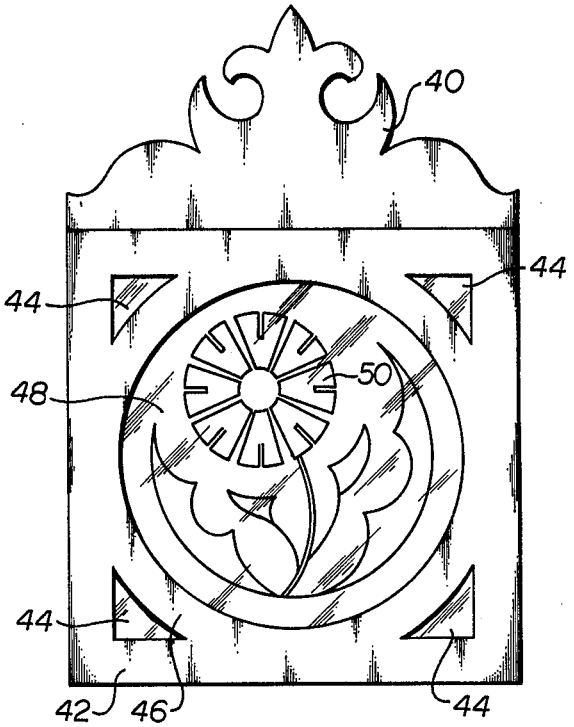
Fig. 4
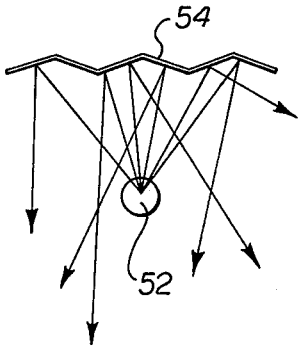
Fig. 5

CANDLE BOX

This is a continuation of application Ser. No. 760,649, filed Jan. 19, 1977 and now abandoned.

BACKGROUND OF THE INVENTION

Historically people have used candles both to light their homes and to provide an atmospheric or decorative touch. Candles have, in modern times, been used in a variety of containers, many of which have been particularly designed to imitate or represent fixtures which were used when candles were the only source of light. Many containers are particularly designed for use with candles and the containers have been designed to be attractive whether or not they have a lighted candle therein, thereby serving as decorative pieces. It is in this latter category that the present invention is found and the particular combination of elements in conjunction with the wide variety of colors, designs and shapes that are available makes the inventive candle box a particularly attractive and functional addition to the home.

Candle containers or the like, as noted above, have been utilized for substantial number of years and prior art references known to the inventor which deal with the art of candle or other display boxes include U.S. Pat. No. Des. 235,159 granted to Ball on May 20, 1975, which deals with a candle holder of a transparent cylindrical variety having a plurality of designs painted or otherwise imprinted thereon.

U.S. Pat. No. Des. 236,187 granted to Van Spronsen on Aug. 5, 1975, shows a packaging container having openings at appropriate locations such that the object packaged can easily be seen.

U.S. Pat. No. 902,597 granted to Noe Jr. on Nov. 3, 1908, deals with a candle shade having a plurality of designs on the exterior thereof. The candle shade cooperates with a transparent mantle which surrounds the flame.

U.S. Pat. No. 1,134,878 granted to Laszczak on Apr. 6, 1915, deals with a candle powered lantern with unique venting structures.

U.S. Pat. No. 2,735,285 granted to Ferleger on Oct. 21, 1956, deals with a candle and casing combination wherein the shell is translucent and melts with the candle.

U.S. Pat. No. 786,610 granted to Terry on Apr. 4, 1905 discloses a toy wherein a transparent strip is movable across the front of an enclosed box having air and ventilation holes therein.

U.S. Pat. No. 2,298,940 granted to Hayes Oct. 13, 1942 discloses a display device including a parabolic reflector and a light bulb and the light is shown through a translucent main body portion having the desired design of a more transparent nature.

With the above noted prior art in mind, it is the object of the present invention to provide a safe and attractive holder for a candle.

Another object of the present invention is to provide a decorative candle holder wherein the combination of the design on the transparent panel and the reflective rear panel renders a double image greatly enhancing the product.

Yet another object of the present invention is to provide a candle holder which, while being utilized in conjunction with a candle, provides light in an attractive container, a container which, even without a lighted candle, serves to enhance the decor of the surroundings.

Still a further object of the present invention is to provide an attractive candle box which shields the candle from unnecessary drafts and yet permits a sufficient amount of air to enter the container to provide efficient combustion of the candle.

Another object of the present invention is to provide a rigid candle container wherein a reflective member as well as a transparent member are slidingly received in the sides of the rectangular box thereby preventing movement thereof following assembly.

Yet another object of the present invention is a rectangular candle box wherein the radiant light from the candle source is reflected and visible from several directions.

Still another object of the present invention is to provide a rectangular candle box wherein the openings at the sides and top are of a sufficient size to admit exterior light to illuminate the box when an internal source of light is not used.

BRIEF DESCRIPTION OF THE DRAWINGS

FIG. 3 is a side view partially broken away of the candle box of FIG. 1.

FIG. 4 is an elevational view of yet another embodiment of the candle box.

FIG. 5 is an enlarged view of a multi-faceted reflective surface.

DETAILED DESCRIPTION OF THE DRAWINGS

Figure 1:
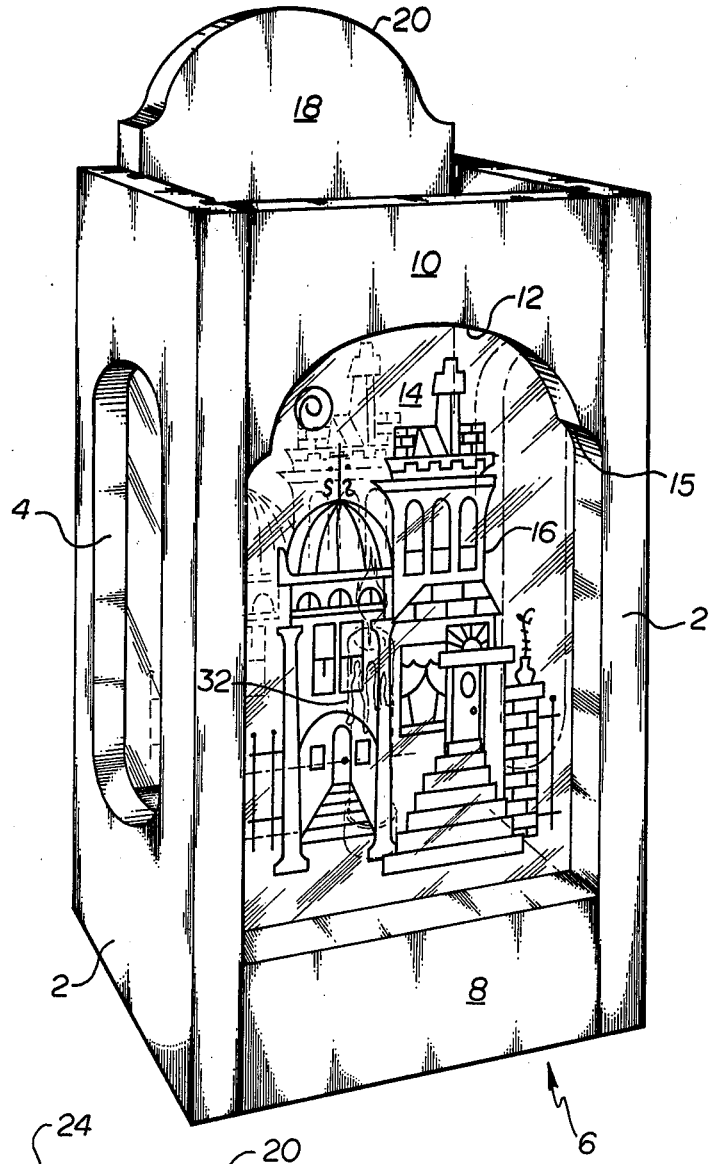
FIG. 1 is an isometric view of one of the preferred embodiments of the inventive candle box.

As seen in FIG. 1, the preferred embodiment of the candle box includes a pair of side portions 2 each having a vent or opening 4 to permit the inward flow of air and visability to the interior. The side vents are of a sufficient size to permit a candle to pass therethrough as well as admitting air for combustion and external light to the luminaire of the interior of the box when a candle is not used. Mounted between the side portions 2 is a front portion generally designated as 6 having a lower rail member 8 and an upper rail member 10. The upper rail member, as seen in this view, has an arcuate lower surface 12 and a fluted portion 15. Mounted between the side walls 2 and the rails 8 and 10 is a transparent member 14 having a pictorial design 16 thereon.

Figure 2:
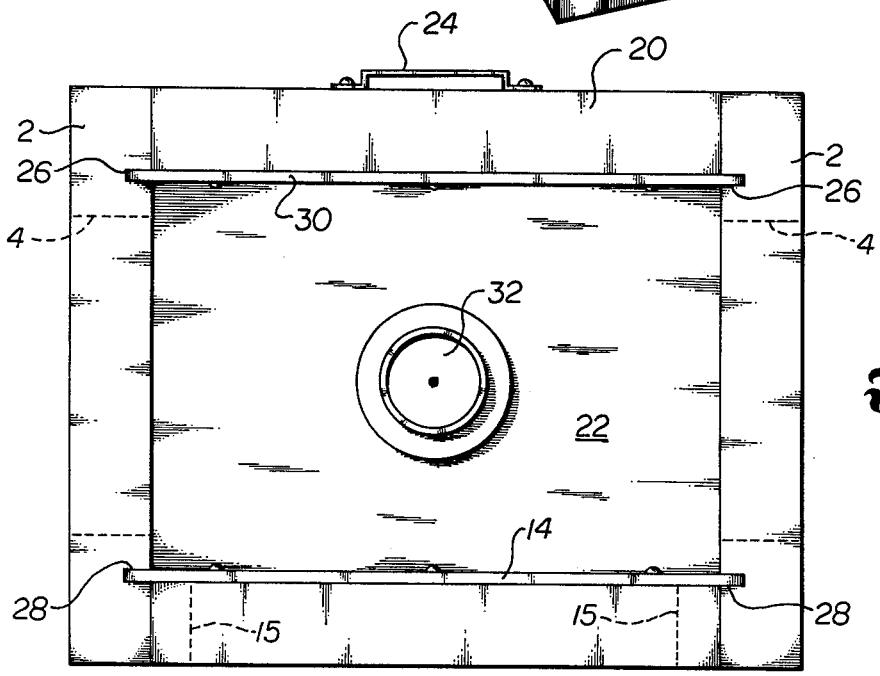
FIG. 2 is a top view of the candle box of FIG. 1.

The box is completed by a vertical back portion 18 having a designed upper surface 20 and a bottom 22, see FIG. 2, thereby resulting in an open top container having easy access to the candle and because of the structure a somewhat directed light source.

Referring now in particular to FIG. 2 it can be seen that a hanger 24 is secured to the upper portion of the back 20, enabling the box to be mounted upon a wall. The side portions 2 include parallel slots 26, 28 to receive and secure the reflective member 30 adjacent the back portion and further secure the transparent portion 24 at the front of the box.

Also seen in this view is the placement of the candle 32 in the center of the candle box, a position which provides sufficient circulation of air, thereby protecting the wood from charring as well as placing it in an optimal position as a light source.

Referring now to FIG. 3, it can be seen that the reflective rear portion 30 is secured and prevented from any horizontal or vertical movement by means of cross pieces 34, 36 secured to the back adjacent slots 26, 28 in the side members 2. The transparent portion is similarly secured in position by means of the cross-pieces 34, 36 and the slots 26, 28, thus assuring a stable and attractive decorative light source. Cross pieces 34, 36 also serve to protect the edges of the glass from contact with the hands or fingers which could result in cuts or scratches.

Referring now to FIG. 4, a second embodiment of the present invention can be seen. As seen in this view, the back portion 40 has a scroll-like design and the front portion 42 has several window-like openings 44 as well as a circular frame type element 46 surrounding the transparent portion 48 and having a design 50 thereon. Thus, as is readily apparent, the candle box, without structural alterations, may take any one of a number of configurations. Further, it is to be understood that the transparent panel may have placed thereon a large variety of designs or pictures. The designs or pictures may, in addition to being of a variety of shapes and colors, be of a combination of transparent and translucent pigments.

Referring now to FIG. 5, it is within the scope of the present invention to provide a candle box such as described hereinabove wherein the candle 52 is placed a distance from a multi-faceted reflecting member 54 thus causing the light to be directed outwardly in several different directions as indicated by the arrows resulting in a more diffused and even softer light.

Thus, as can be seen, the present invention results in a novel and attractive holder for candles which may be placed upon a table or the like or alternatively may be safely mounted to a wall. With a candle in position and lit, the design placed upon the transparent panel is actually projected outwardly and can be seen upon an adjacent ceiling. It also must be recognized that the box although designed for a candle may well be used as a holder for a potted plant or the like.

What is claimed is:

1. A decorative open top candle and display box which is attractive and appears to be illuminated whether or not it contains a light source, comprising a substantial rectangular main body portion including a back member having a reflective element secured to its inner surface, a pair of parallel side members secured to the back member and extending outwardly in a forward direction therefrom, said side members including openings occupying a substantial portion of the side surface to admit air to fuel a candle when a candle is used as a light source and further to admit sufficient light to reflect on the reflective surface and when combined with the light from the top illuminate the box when an internal light source is not used, a bottom to support an optional source of light and a front completing the box, the front including a transparent panel occupying a substantial portion of the front surface having decoration thereof which will be both illuminated and reflected by the reflective element.

* * * * *